US005476042A

United States Patent [19]

Ehrhard et al.

[11] Patent Number: 5,476,042

[45] Date of Patent: Dec. 19, 1995

[54] METHOD AND APPARATUS FOR APPLYING A LIQUID MEDIUM TO A PRINTING CARRIER IN OFFSET PRINTING MACHINES

[75] Inventors: Toni Ehrhard, Breuberg; Georg Hartung, Selignestadt; Manfred Herold, Hainburg; Ulrich Jung, Limburg, all of Germany

[73] Assignee: MAN Roland Druckmaschinen AG, Germany

[21] Appl. No.: 279,236

[22] Filed: Jul. 22, 1994

[30] Foreign Application Priority Data

Jul. 22, 1993 [DE] Germany ..... 43 24 631.1

[51] Int. Cl.[6] ..... B41F 31/00

[52] U.S. Cl. ..... 101/352; 101/210; 101/485; 101/366

[58] Field of Search ..... 101/207–211, 348, 101/349, 350, 351, 352, 363, 366, 483, 485, 486, 247; 118/258, 259, 248, 261, 262; 427/428

[56] References Cited

U.S. PATENT DOCUMENTS

| | | | |
|---|---|---|---|
| 2,333,962 | 11/1943 | Terry | 101/362 |
| 4,308,796 | 1/1982 | Sattewhite | 101/352 X |
| 4,429,631 | 2/1984 | Commers | 101/349 |
| 4,554,869 | 11/1985 | Ranno, Sr. | 101/349 X |
| 5,154,602 | 10/1992 | Harrison | 101/351 |
| 5,265,535 | 11/1993 | Isowa et al. | 101/350 |
| 5,335,596 | 8/1994 | DeMoore et al. | 101/350 |
| 5,357,862 | 10/1994 | Kohara | 101/348 |

FOREIGN PATENT DOCUMENTS

| | | | |
|---|---|---|---|
| 0071180A1 | 2/1983 | European Pat. Off. . | |
| 257365 | 3/1988 | European Pat. Off. | 101/349 |
| 2902047 | 7/1979 | German Dem. Rep. | 101/349 |
| 3427898C1 | 11/1985 | Germany . | |
| 39088B | 4/1989 | Germany . | |
| 2051688 | 1/1981 | United Kingdom | 101/DIG. 49 |
| 1601603 | 11/1981 | United Kingdom | 101/349 |

*Primary Examiner*—Chris A. Bennett
*Attorney, Agent, or Firm*—Leydig, Voit & Mayer, Ltd.

[57] ABSTRACT

A method and apparatus for applying a liquid medium to a printing carrier in offset printing machines. It is suitable for processing media of different viscosity, such as low-viscosity dispersion lacquers or higher-viscosity bronze and effect printing inks. In order to guarantee precise metering, two function modules are assigned in an exchangeable manner to a forme cylinder in two bearings. If processing of low-viscosity media is required, the first function module, consisting at least of a metering roller and an applicator roller, is used. For processing higher-viscosity media, the second function module, consisting at least of a screened applicator roller and a chamber-type doctor, is used.

6 Claims, 3 Drawing Sheets

METHOD AND APPARATUS FOR APPLYING A LIQUID MEDIUM TO A PRINTING CARRIER IN OFFSET PRINTING MACHINES

BACKGROUND OF THE INVENTION

This invention relates to a working method and an apparatus for applying a liquid medium to a printing carrier in offset printing machines. The apparatus is suitable for processing low-viscosity and higher-viscosity media, such as, for example, dispersion lacquer on an aqueous basis (low-viscosity with a viscosity ≦0.1 Pa s) or bronze and effect printing ink with a specific pigment proportion (higher-viscosity with a viscosity of 0.1 to 2 Pa s) such as, for example, gold lacquer.

Various arrangements are known for applying liquid media to a printing carrier. According to DE 3,427,898 C1, the metering of the medium to be applied takes place by means of a metering roller and an applicator roller according to the principle of squeeze rollers, the liquid (e.g., lacquer) being supplied to the roller gap by means of a tube so as to form a lacquer wedge.

A chamber-type doctor is known from EP 0,071,180 A1 and is essentially forme by a housing with side walls and doctor blades, also called squeegees, attached to the housing. The doctor blades are supported on the applicator roller, and the liquid is transferred to the screened applicator roller via the chamber thus forme. In this case, the chamber-type doctor is pivotably mounted in a holder arranged above the applicator roller and can be engaged against the applicator roller by an operating cylinder acting on the holder.

The known arrangements are disadvantageous in that they do not guarantee precise metering of the medium to be applied in the case of media of different viscosity. The known arrangements thus cannot be used universally for applying the respectively used liquid to the printing carrier.

SUMMARY OF THE INVENTION

The general object of the present invention is to eliminate the disadvantages of the prior art and specifically to achieve this by enabling the metering roller and the chamber-type doctor to be exchanged quickly in combination with the respective applicator roller as function modules in an offset printing machine.

When processing low-viscosity media (≦0.1 Pa s), the first function module is used. An applicator roller (rubber-coated or steel) and a metering roller (steel or rubber-coated) are inserted in each case into the laterally fixed, eccentric bearings for the applicator roller and metering roller.

When processing higher-viscosity media (≧0.1 to 2 Pa s), the second function module is used. A screened applicator roller is then inserted in the above-mentioned eccentric bearings and a chamber-type doctor is inserted in the bearing for the metering roller. The eccentric bearings for the first function module (applicator roller/metering roller) thus serve at the same time to receive the second function module (screened applicator roller/chamber-type doctor) after the first function module has been exchanged from the bearings. The printing engagement with the applicator roller takes place by means of a single engagement bearing (for the metering roller or the chamber-type doctor). Economic processing of liquid media in in-line operation of an offset printing machine thus becomes possible. The apparatus can be converted within a short time for processing the respective medium and guarantees precise metering of the liquids.

In this case, the apparatus can be arranged upstream of the first printing unit of an offset printing machine for finishing (e.g., lacquering) applying covering layers, arranged between the printing units or arranged downstream of the printing unit. The solution according to the invention is suitable for spot lacquering (intermittent lacquering) and for full-surface lacquering. A further finishing apparatus can likewise be arranged upstream or downstream of the apparatus according to the invention, for example, a further lacquering unit for full-surface lacquering or a laminating or embossing apparatus.

These and other objects and advantages of the invention will become more apparent from the following detailed description when taken in conjunction with the accompanying drawings.

Figure 1:
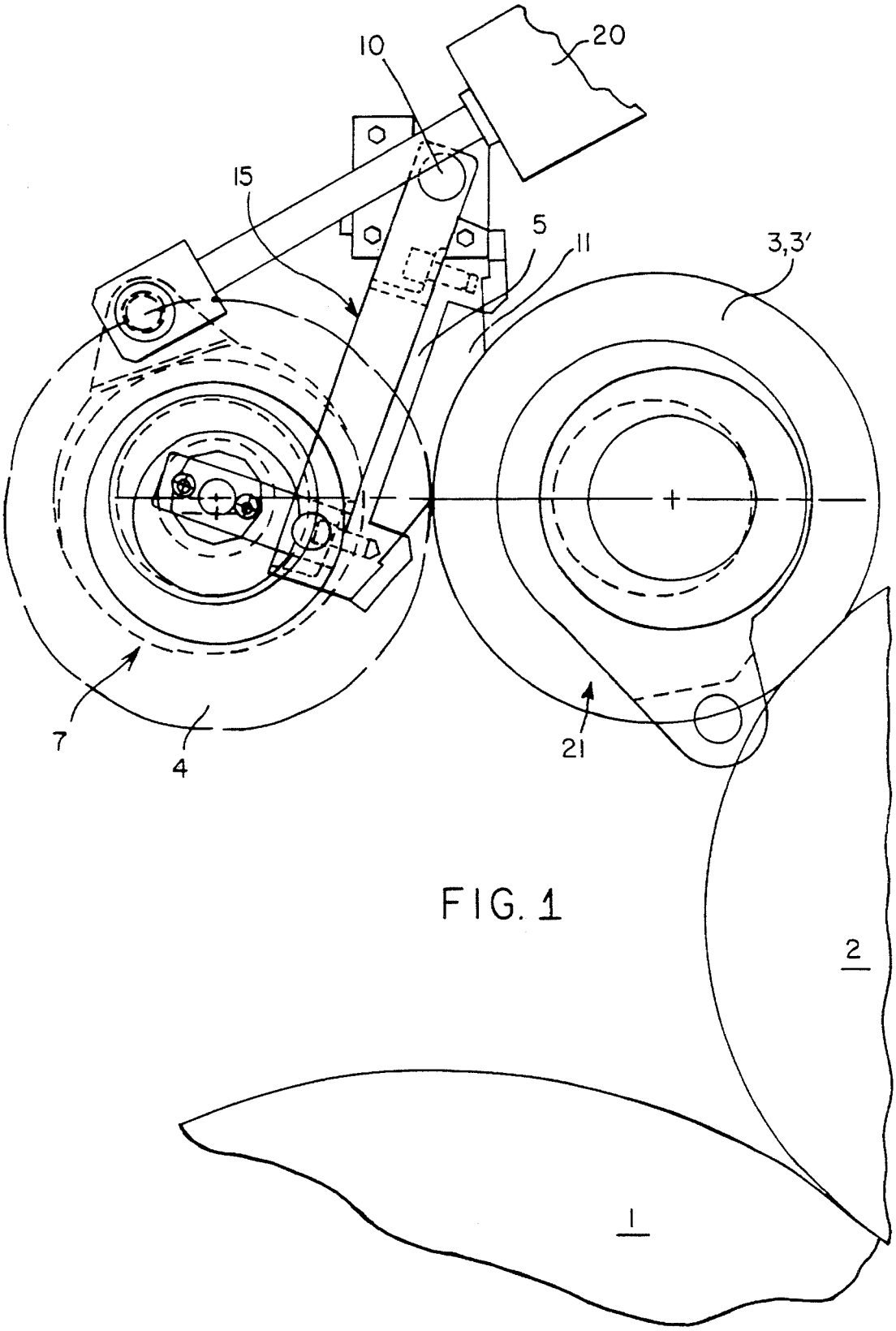
FIG. 1 shows the basic construction of the apparatus of the invention, the metering roller and the chamber-type doctor being illustrated superimposed.
Figure 2:
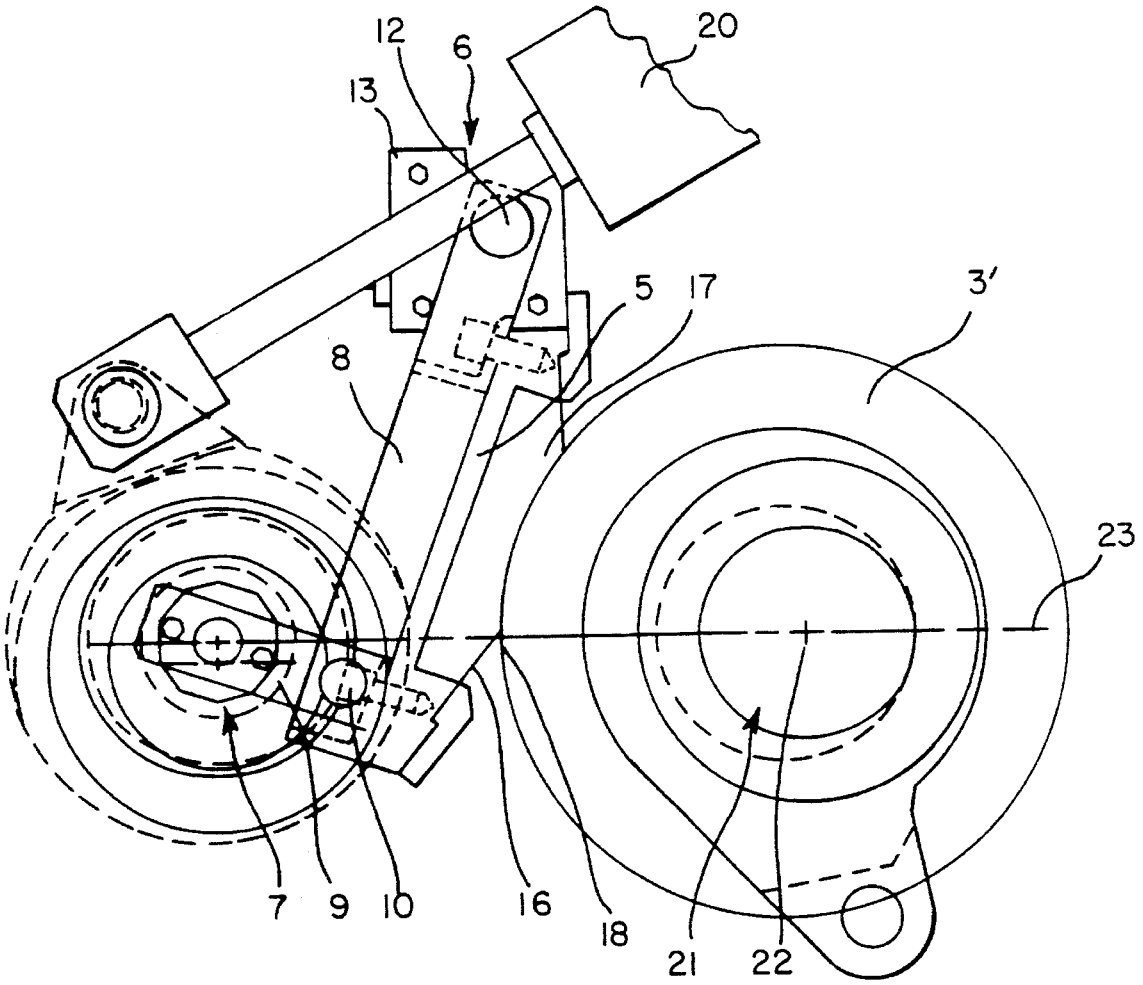
FIG. 2 is an enlarged side view showing the apparatus for processing higher-viscosity media.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Figure 3:
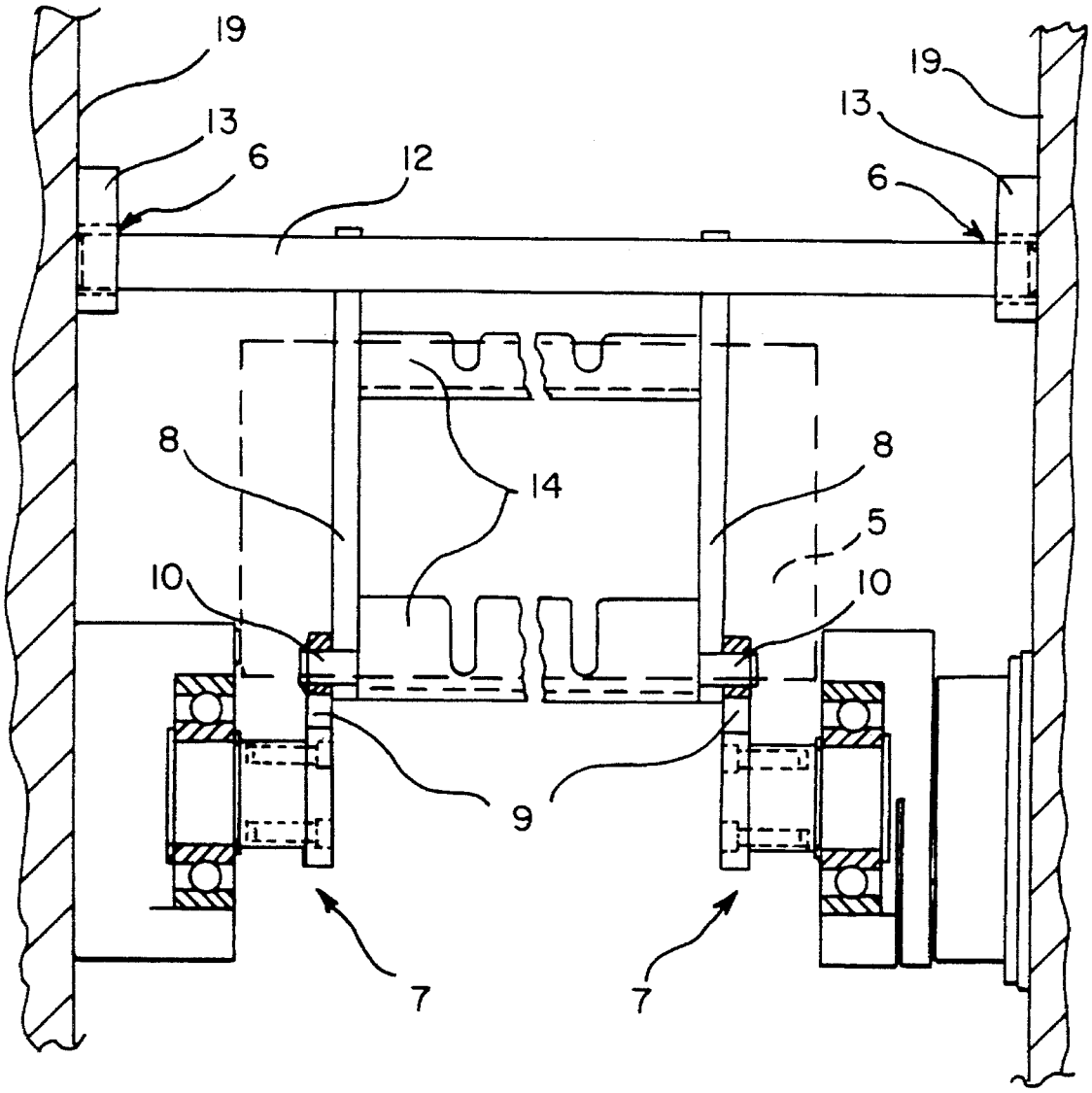
FIG. 3 is a front view showing the bearings of the chamber-type doctor.

In an offset printing machine, the apparatus according to the invention is arranged downstream of the last printing unit and serves for the in-line lacquering of printing carriers. In this case, the apparatus consists of a sheet-feeding cylinder 1 to which a forme cylinder 2 is assigned. An applicator roller 3 is assigned to the forme cylinder 2. Assigned optionally so as to be engageable against the applicator roller 3 is a metering roller 4 or a chamber-type doctor 5. The cylinder 1, the forme cylinder 2, the applicator roller 3, the metering roller 4 and the chamber-type doctor 5 are mounted in laterally spaced frames 19 (FIG. 3), the metering roller 4 and the applicator roller 3 being received in eccentric bearings 7 and 21, respectively. The metering roller 4 and the applicator roller 3 are received in each case in bearings 7, 21 of two-part construction so that the upper parts are connected releasably in a positive-locking manner to the lower parts of the bearings 7, 21 attached in the side frames 19. The bearing 7 of the metering roller 4 is designed in each case as an engagement bearing 7 in the form of an eccentric bearing. Arranged on the engagement bearing 7 is an actuating means 20, for example, an operating cylinder, for printing engagement (engagement/disengagement of printing). A pivoting bearing 6 is arranged as a bearing for the chamber-type doctor 5 above a roller gap forme by the metering roller 4 and applicator roller 3 on both sides in the side frames 19. The chamber-type doctor 5 is attached releasably to a frame 15, for example, consisting of supports 8 and struts 14, by means of quick-acting closures. The supports 8 are arranged on a crossmember 12 of circular construction, the crossmember 12 and the bearing plates 13 forming in each case a pivoting bearing acting as a hinge. A coupler 9 is linked to the frame 15 on both sides, in each case by a hinge 10. The coupler 9 is furthermore rotatably linked to each engagement bearing 7 which otherwise also receive the metering roller 4. The chamber-type doctor 5 attached to the frame 15 has, in addition to a screened applicator roller 3', a positively inclined closing doctor blade 17 and a negatively inclined working doctor blade 16. In this case, the working doctor blade 16 is supported on the circumference of the screened applicator roller 3' at a point of engagement 18 which lies on a line 23 at the height of the middle 22 of the eccentric bearing 21 of the applicator roller 3'. The chamber-type doctor 5 has an apparatus for supplying and removing the medium to be processed in each case, which apparatus is not described in detail here. Two function modules can thus be assigned to the forme cylinder 2.

The first function module may be forme by the metering roller 4 in a steel construction and the applicator roller 3 with rubber coating. The forme cylinder 2 carries, for example, a rubber blanket for full-surface lacquering. Alternatively, the metering roller 4 may be provided with a rubber coating and the applicator roller 3 may be constructed of steel. In this case, the forme cylinder 2 carries a flexographic printing plate or an intermittent rubber blanket for intermittent lacquering (spot lacquering).

The second function module is forme by the chamber-type doctor 5, the frame 15, the pivoting bearing 6 and an applicator roller 3' with a screen well structure. The screened applicator roller 3' is constructed, for example, of ceramics.

The functioning of the apparatus is as follows: If a conventional, low-viscosity lacquer is processed, the first function module is used. The metering roller 4 and the applicator roller 3 receive the lacquer to be processed via a feed pipe (not shown) in the roller gap 11 so that a lacquer wedge is forme therein. By actuating the cylinder 20, the eccentric engagement bearing 7 is pivoted in such a way that the metering roller 4 is engaged with or disengaged from the applicator roller 3 in printing engagement or disengagement of printing, respectively. The metering takes place according to the principle of squeeze rollers, and the applicator roller 3 conveys the lacquer to the forme cylinder 2 which transfers the lacquer to the printing carrier in conjunction with the sheet-feeding cylinder 1.

If an application with higher-viscosity lacquer such as, for example, bronze or effect printing ink, is to be processed, the second function module is used. For this purpose, the upper part of the engagement bearing 7 is released and the metering roller 4 is taken out. The lacquer feed pipe is removed from above the roller gap 11, and the upper part of the bearing 21 of the applicator roller 3 is opened so that the roller 3 can likewise be removed. A screened applicator roller 3' is placed in the applicator roller bearing 21 and the upper part of the bearing 21 is re-connected to the lower part. The coupler 9 with the frame 15 and chamber-type doctor 5 is inserted in the engagement bearing 7 and the upper part of the engagement bearing 7 is connected to the lower part. Beforehand, the frame 15 with the crossmember 12 is placed in the pivoting bearing 6. The chamber-type doctor is coupled to a lacquer supply and a lacquer removal. The chamber-type doctor 5 is engaged (engagement/disengagement of printing) with the applicator roller 3' by the actuating cylinder 20 acting on the engagement bearing 7. In this case, the working doctor blade 16 engages at the height (line 23) of the middle 22 of the bearing 21 of the applicator roller 3' on the circumference thereof in the point of engagement 18 in order to vary the engagement conditions as little as possible when adjusting the eccentric bearing 21.

If after the use of higher-viscosity lacquer, low-viscosity lacquer is to be processed again, the upper part of the engagement bearing 7 is removed and the coupler 9 with the frame 15 and the chamber-type doctor 5 is taken out. Beforehand, the chamber-type doctor 5 is emptied and the supply lines are disconnected.

Advantageously, the crossmember 12 can remain in the bearing plate 13 of the pivoting bearing 6, and the coupler 9, the frame 15 and the chamber-type doctor 5 may be pivoted into a parked position above the engagement bearing 7 and retained there. The screened applicator roller 3' may be removed from its bearing 21, and an applicator roller 3, e.g., of steel construction, may be inserted and fixed in such bearing. Inserted in the engagement bearing 7 is the metering roller 4 which was previously deposited (parked), for example, in a roller holder on the machine housing. The metering roller 4 is engaged (engagement/disengagement of printing) with the applicator roller 3 by the actuating means 20 arranged on the eccentric engagement bearing 7. Beforehand, the lacquer feed pipe was again positioned above the roller gap 11 and coupled to a feed line. The metering roller 4 has a separate drive which is coupled to the applicator roller 3. Two freewheels are arranged on the axle of the applicator roller 3. One freewheel is coupled to the separate drive of the metering roller 4, and the other freewheel is coupled to the train of gears of the printing machine (input drive). During printing engagement, the input drive of the printing machine overtakes the separate input drive of the metering roller 4. During disengagement of printing, the input drive of the machine is disconnected (stopped) and the separate input drive continues to drive the applicator roller 3. The lacquer is thus prevented from drying on the roller surface. When using the chamber-type doctor 5, the procedure is analogous since the drive is coupled only to the bearings 7, 21.

We claim:

1. A method for applying different types of liquid media to the forme cylinder of offset printing apparatus having applicator roller means engageable with said cylinder and having laterally spaced bearings, said method comprising the steps of, supporting a metering roller with said bearings, moving said bearings to shift said metering roller into engagement with said applicator roller means, and metering a first liquid medium between said metering roller and said applicator roller means, moving said bearings reversely to shift said metering roller out of engagement with said applicator roller means, removing said metering roller from said bearings, supporting a chamber-type doctor with said bearings, moving said bearings to shift said chamber-type doctor into engagement with said applicator roller means, and metering a different liquid media onto said applicator roller means by way of said chamber-type doctor.

2. A method as defined in claim 1 in which said apparatus includes second bearings and in which said applicator roller means comprise first and second different types of applicator rollers selectively supportable by said second bearings, said method comprising the steps of, supporting said first type of applicator roller in said second bearings when said metering roller is supported by said laterally spaced bearings, and removing said first type of applicator roller from said second bearings and supporting said second type of applicator roller in said second bearings when said metering roller is removed from said laterally spaced bearings and said chamber-type doctor is supported with said laterally spaced bearings.

3. Apparatus for applying different types of liquid media to a forme cylinder, said apparatus comprising a first set of laterally spaced bearings, a second set of laterally spaced bearings, means for moving said first set of bearings toward and away from said second set of bearings, first and second different applicator rollers selectively supported by said second set of bearings and engageable with said forme cylinder and a metering roller and a chamber-type doctor selectively supported by said first set of bearings.

4. Apparatus as defined in claim 3 in which said metering roller is supported by said first set of bearings and said first applicator roller is supported by said second set of bearings when low-viscosity media is applied to said forme cylinder, said chamber-type doctor being supported by said first set of bearings and said second applicator roller being supported by said second set of bearings when high-viscosity media is applied to said forme cylinder.

5. Apparatus as defined in claim 4 further including means mounting said chamber-type doctor for swinging away from said first set of bearings to a parked position when said metering roller is supported by said first set of bearings.

6. Apparatus as defined in claim 4 in which said chamber-type doctor includes a working doctor blade which is inclined negatively relative to said second applicator rolls when said chamber-type doctor is supported by said first set of bearings and said chamber-type doctor is supported by said second set of bearings, said doctor blade engaging said second applicator roller in a generally horizontal plane containing the axis of said second applicator roller.

* * * * *